US008621674B2

(12) United States Patent
Perreault et al.

(10) Patent No.: US 8,621,674 B2
(45) Date of Patent: Jan. 7, 2014

(54) REVERSIBLE BASEBALL OR SOFTBALL CHEST PROTECTOR

(75) Inventors: David Perreault, Laval (CA); Thomas Hoke, West Hills, CA (US); Dmitry Rusakov, Montreal (CA)

(73) Assignee: Easton Sports, Inc., Van Nuys, CA (US)

( * ) Notice: Subject to any disclaimer, the term of this patent is extended or adjusted under 35 U.S.C. 154(b) by 284 days.

(21) Appl. No.: 13/174,515

(22) Filed: Jun. 30, 2011

(65) Prior Publication Data

US 2013/0000024 A1 Jan. 3, 2013

(51) Int. Cl.
*A41D 13/05* (2006.01)

(52) U.S. Cl.
USPC ..... 2/463; 2/267

(58) Field of Classification Search
USPC ..... 2/463, 267, 455, 456, 459, 461, 2/464–467, 268, 44, 92, 468
See application file for complete search history.

(56) References Cited

U.S. PATENT DOCUMENTS

| | | | | | |
|---|---|---|---|---|---|
| 1,670,239 | A | * | 5/1928 | Cline | 2/463 |
| 3,076,197 | A | * | 2/1963 | Glahe | 2/463 |
| 3,248,738 | A | * | 5/1966 | Morgan | 2/462 |
| 4,486,901 | A | * | 12/1984 | Donzis | 2/462 |
| 4,513,449 | A | * | 4/1985 | Donzis | 2/462 |
| 4,847,913 | A | * | 7/1989 | Chen | 2/463 |
| 4,993,076 | A | * | 2/1991 | Dierickx | 2/463 |
| 5,423,087 | A | * | 6/1995 | Krent et al. | 2/463 |

OTHER PUBLICATIONS

Gen X, Global Reversible Chest Protector, Feb. 2010.
Macho, Reversible Hogu Chest Protector, Mar. 2006.
Schutt Sports, S3 Chest Protector, 2011.

* cited by examiner

*Primary Examiner* — Amy Vanatta
(74) *Attorney, Agent, or Firm* — Perkins Coie LLP

(57) ABSTRACT

A reversible chest protector includes internal padding configured to absorb impacts against both the front and rear-facing surfaces of the chest protector. The chest protector includes inner and outer layers of fabric that are molded to an internal foam core. The foam core may include outer layers of closed-cell foam molded to the fabric layers, and an internal layer of open-cell foam molded to the closed-cell foam layers, such that the padding layup is symmetrical. Other features and advantages will appear hereinafter.

15 Claims, 4 Drawing Sheets

REVERSIBLE BASEBALL OR SOFTBALL CHEST PROTECTOR

BACKGROUND

Protective gear, such as chest protectors, helmets, masks, and shin guards, has long been used to protect baseball and softball catchers from pitched balls and balls deflected or "foul-tipped" off of bats. Chest protectors are typically made from a relatively flexible material, and generally have energy-absorbing foam or other energy-absorbing padding sewn or stitched into the flexible material for absorbing the impact of a pitched or tipped baseball or softball. Straps are commonly attached to the chest protector for securing the chest protector around the back of the catcher.

Chest protectors often include energy-absorbing padding that is stacked asymmetrically to absorb impact particularly well from objects striking the front-facing surface of the chest protector. The energy-absorbing padding is typically a closed-cell foam material capable of withstanding and absorbing significant impacts from a ball. As a result, the wearer is protected, and the ball is prevented from deflecting or bouncing a great distance from the wearer due to the energy-absorbing characteristics. An outer layer of fabric is typically stitched to the energy-absorbing padding, while an inner layer of fabric is typically stitched or compression-molded to the energy-absorbing padding.

SUMMARY

A reversible chest protector includes internal padding configured to absorb impacts against both the front and rear-facing surfaces of the chest protector. The chest protector includes inner and outer layers of fabric that are molded to an internal foam core. The foam core optionally includes outer layers of closed-cell foam molded to the fabric layers, and an internal layer of open-cell foam molded to the closed-cell foam layers, such that the padding layup is symmetrical. Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

Figure 1:
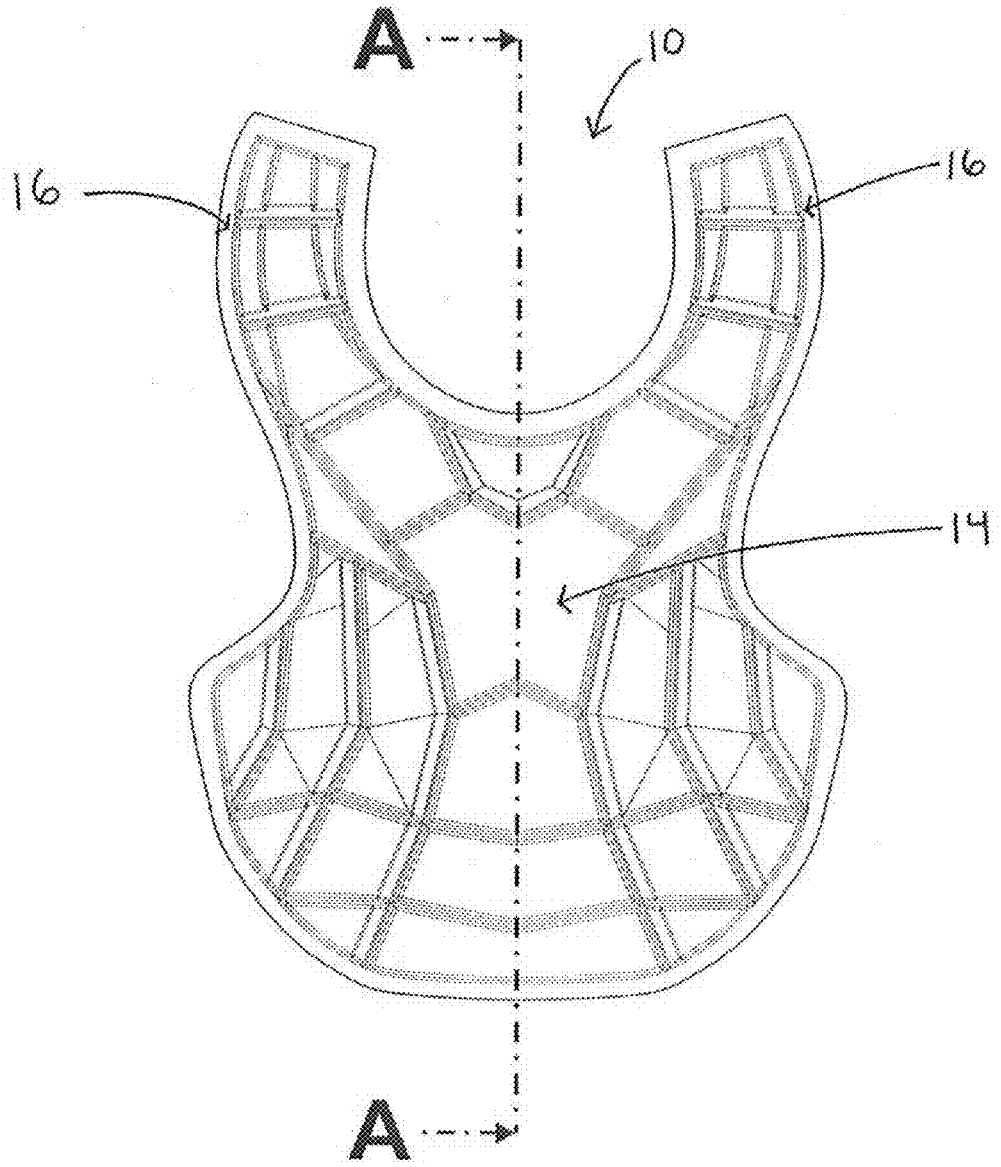
FIG. 1 is a perspective view of the main body of a reversible chest protector, according to one embodiment.

Turning now in detail to the drawings, as shown in FIG. 1, a reversible chest protector 10 includes a torso-protecting region 14 and two shoulder-protecting regions 16. The reversible chest protector 10 will be referred to herein as having a "home" side and an "away" side—to indicate a team's differing uniform indicia—but any other markings or indicia may be included on the two sides, or the front and rear-facing surfaces, of the protector 10. Because the protector 10 is reversible, it may be oriented such that either the home side or the away side is the front-facing, impact-absorbing side during a given situation.

Figure 2:
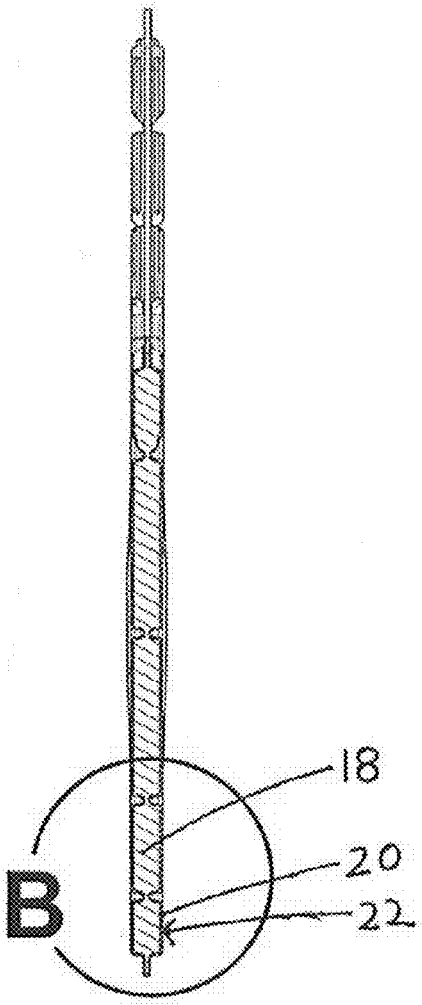
FIG. 2 is a sectional view of the reversible chest protector shown in FIG. 1 taken along line A-A of FIG. 1.
Figure 3:
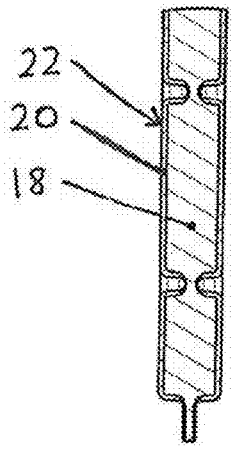
FIG. 3 is a magnified view of Section B of FIG. 2.

As shown in FIGS. 2 and 3, the reversible chest protector 10 includes a symmetrical pad layup such that the protector 10 is capable of absorbing impacts equally from either side. In one embodiment, the chest protector 10 includes an inner foam core element 18, two outer foam core elements 20 having substantially the same thickness as each other, and two external fabric layers. The fabric layers 22 may be made of spandex (for example, Lycra®), nylon, or of another suitable material. The foam and fabric layers are preferably molded together, via compression-molding or a similar process, to provide a rigid outer surface relative to one formed by stitching external fabric to a foam core. Any other number of core elements, made of any suitable materials, may alternatively be used.

Because the outer fabric layers 22 are compression-molded to the outer foam core elements 20—and each outer surface of the protector 10 is therefore relatively rigid and capable of dissipating energy—the inner foam core element 18 does not need to absorb as much energy as a traditional foam core to dissipate the same amount of impact energy. Thus, in one embodiment, the inner foam core element 18 may be an open-cell foam, such as polyurethane foam. This inner core material preferably has a density of approximately 22 to 28 $kg/m^3$. Such a foam is typically much less expensive than a traditional closed cell, energy-absorbing foam. In this embodiment, the two outer foam core elements 20 may each be a closed-cell, energy-absorbing foam, such as a cross-linked polyethylene. This outer core material preferably has a density of approximately 100 to 110 $kg/m^3$.

The inner foam core element 18 may be substantially thicker than the two outer foam core elements 20 combined, since the compression-molding process provides rigid, energy-dissipating outer surfaces. In one embodiment, the inner foam core element 18 has a thickness of approximately 14.5 mm to 15.5 mm, while each outer foam core element 20 has a thickness of approximately 3.5 mm to 4.5 mm.

The compression-molded chest protector 10 has the surprising ability to "deaden" a ball upon impact, such that the ball does not deflect or bounce far from the catcher. It was initially expected that the ball would bounce a great distance off of the protector 10 due to the relative rigidity of the outer surfaces. The compression-molded outer surfaces, however, effectively dissipate energy over a large area such that ball deflections are minimal. Thus, the compression-molded chest protector 10 provides not only reversibility and sufficient energy absorption to protect the wearer, but it also sufficiently deadens a ball upon impact such that the ball does not end up a great distance from the catcher.

Figure 4A:
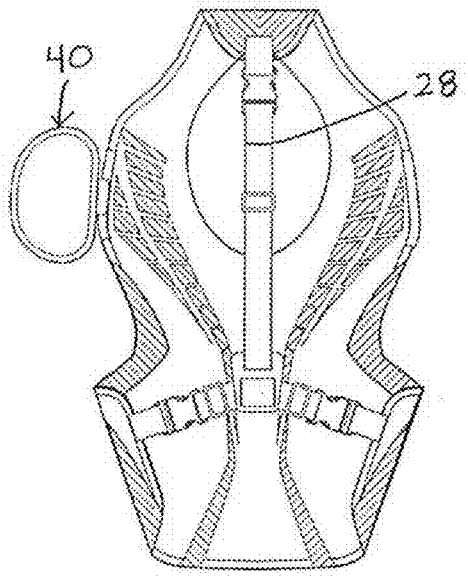
FIG. 4A is a perspective view of a first side of a patterned reversible chest protector, according to one embodiment.
Figure 4B:
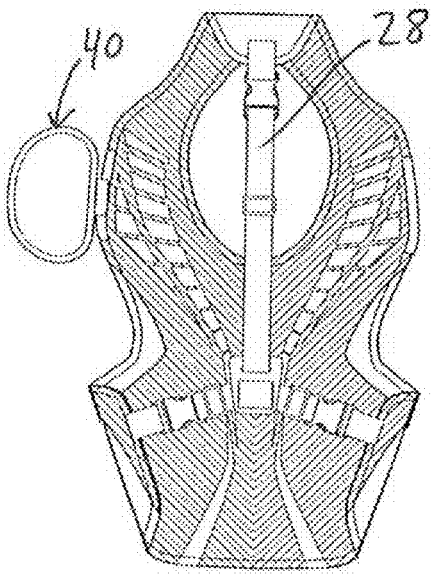
FIG. 4B is a perspective view of a second side of the patterned reversible chest protector shown in FIG. 4A.
Figure 5:
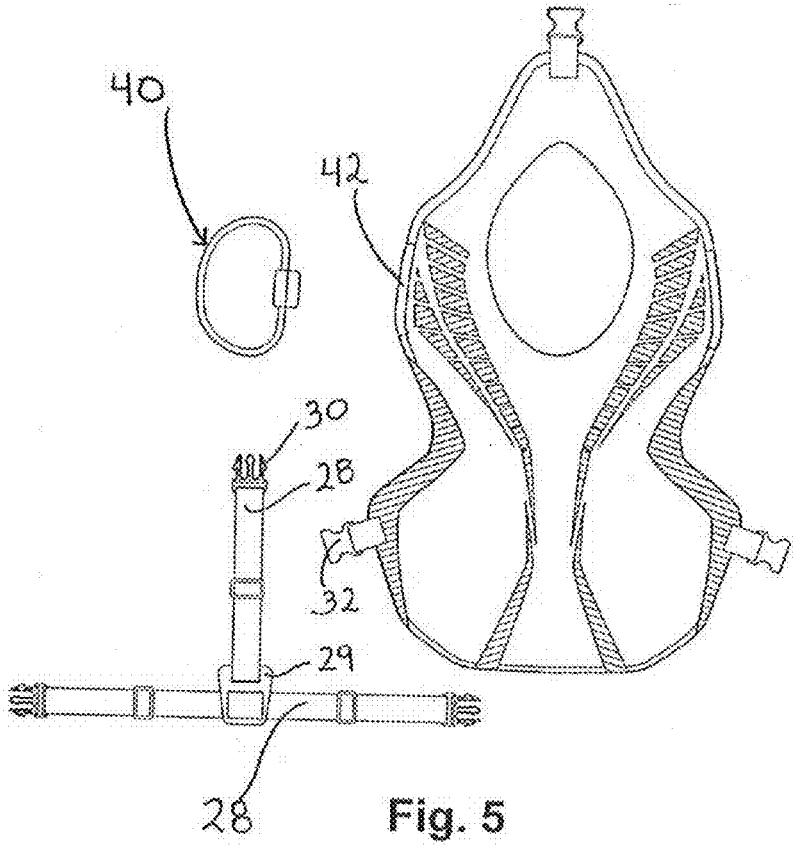
FIG. 5 is a perspective view of the chest protector shown in FIGS. 4A and 4B with the straps and shoulder pad removed from the chest protector.
Figure 6:
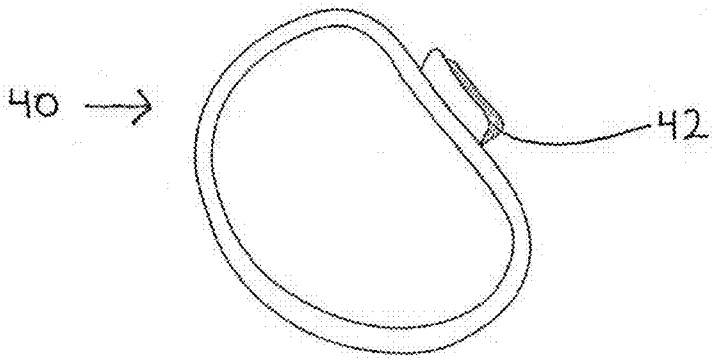
FIG. 6 is a perspective view of the removable shoulder pad shown in FIGS. 4A, 4B, and 5.

As shown in FIGS. 4A and 4B, one or more adjustable straps 28, or other elements suitable for securing the chest protector to a wearer, are connected, or detachably connected, to the chest protector 10. In one embodiment, each of the straps 28 is connected to a clip 29 or buckle at one end, and includes an attachment element 30, such as a plastic fastener, at its free or distal end. The attachment elements 30 alternatively may include hooks on swivel bases so that the straps 28 may be rotated when reversing the chest protector between the home and away sides, or may be any other suitable fasteners that allow for reversibility of the chest protector 10. The adjustable straps 28 optionally are made of an elastic material, such as nylon or spandex, such that they are stretchable under loading conditions and are able to return to their original lengths when the load is removed.

Receiving elements 32 are preferably attached, directly or indirectly (e.g., via straps), to lower side regions and to an upper region of the chest protector 10, for receiving the attachment elements 30. Alternatively, the attachment elements 30 may be attached to the lower side regions and the upper region of the chest protector, while the receiving elements 32 may be attached to the free ends of the adjustable straps 28. A wearer may don the chest protector 10 by pulling it over his or her head, such that the shoulder-protecting regions 16 rest on the wearer's shoulders. The wearer may then insert the attachment elements 30 into the corresponding receiving elements 32. If necessary, the wearer (or another person) may tighten or loosen the adjustable straps 28 to provide a proper, secure fit. Any other suitable connecting mechanisms or fastening elements that allow for reversibility of the chest protector 10 may be used to secure the chest protector 10 to the wearer.

Additional padding may optionally be permanently or removably attached to the chest protector 10. As shown in FIGS. 4A, 4B, 5, and 6, for example, one or more shoulder pads 40 or upper arm pads may be removably attached to the shoulder-protecting regions 16 of the protector 10 via hook and loop fasteners 42 and 42' or via any other suitable connectors. A shoulder pad 40 may include different markings or indicia on opposing sides of the shoulder pad, allowing the wearer to alternatively display home and away indicia or other information. Including one or more removable shoulder pads also provides a catcher with the option to remove, for example, a pad that would otherwise protect the catcher's throwing shoulder, thus providing increased freedom of movement when throwing a ball. Alternatively, a catcher could remove a pad that would otherwise protect the catcher's non-throwing shoulder, thus providing increased freedom of movement when reaching for a pitched, batted, or thrown ball. Other additional pads may optionally be included to protect various regions of the wearer's body.

The reversible chest protector 10 may be assembled by cutting the various foam and fabric layers to a desired size, positioning the outer foam cores 20 over the inner foam core 18, and positioning the'fabric layers 22 over the outer foam cores 20 to form a chest protector pre-form structure. The pre-form structure may then be placed into a molding apparatus, such as a compression-molding apparatus. The chest protector pre-form is heated at a temperature of approximately 140° C. to 160° C. for approximately five to seven minutes to form the main body of the chest protector 10. The main body is then allowed to cool, after which it is removed from the molding apparatus.

The receiving elements 32 (or fasteners 30) may then be sewed, or attached via straps, to the side and upper regions of the chest protector 10. Adjustable straps 28 may then be attached to the receiving elements via the fasteners 30 at the distal ends of the straps 28 (or via receiving elements 32 at the distal ends of the straps 28, if the fasteners 30 are instead included on the main body of the chest protector 10).

To reverse the chest protector 10 from an outwardly facing home-side to an outwardly facing away-side, for example, a user may disconnect one or more of the fasteners 30, move the straps 28 to the other side of the protector 10, then reattach the fasteners 30 to the receiving elements 32. For example, a user may disconnect the side-fasteners 30 from the side-receiving elements 32, flip the upper receiving element 32 over to the other side of the protector 10, then re-insert the fasteners 30 into the receiving elements 32. The chest protector 10 may alternatively be reversed in any other suitable manner. For example, the adjustable straps 28 may be detached completely from the protector 10, and then reattached to the other side of the protector.

Any of the above-described embodiments may be used alone or in combination with one another. Furthermore, the reversible chest protector may include additional features not described herein. While several embodiments have been shown and described, various changes and substitutions may of course be made, without departing from the spirit and scope of the invention. The invention, therefore, should not be limited, except by the following claims and their equivalents.

What is claimed is:

1. A reversible baseball or softball chest protector, comprising:

a main body including a first side and a second side, the main body including:

an inner core comprising an open-cell foam;

a first outer core, molded to a first side of the inner core, comprising a closed-cell foam;

a second outer core, molded to a second side of the inner core, comprising a closed-cell foam; and at least one external liner molded to the first outer core and to the second outer core; and means for securing the main body to a wearer and for allowing the first side and the second side to alternatively be positioned facing away from the wearer.

2. The chest protector of claim 1 wherein the inner core has a thickness greater than the combined thickness of the first and second outer cores.

3. The chest protector of claim 1 wherein the first and second outer cores comprise the same closed-cell foam material, and have the same, or substantially the same, thickness.

4. The chest protector of claim 3 wherein the inner core and the first and second outer cores form a symmetrical padding layup, such that impact-absorbing properties of the chest protector are substantially equal for impacts occurring against the first side and the second side of the chest protector.

5. The chest protector of claim 1 wherein the means for securing comprises at least one strap detachably connected to the main body via fasteners.

6. The chest protector of claim 1 further comprising at least one shoulder pad removably connected to the main body via a hook-and-loop fastener.

7. The chest protector of claim 1 wherein the inner core is compression-molded to the first and second outer cores, which are compression-molded to the external liner.

8. The chest protector of claim 1 wherein the external liner comprises a spandex material.

9. A reversible baseball or softball chest protector, comprising:

a main body including a first side and a second side, the main body including:

an inner core comprising a first material having a density of approximately 22 to 28 kg/m$^3$;

a first outer core, on a first side of the inner core, comprising a second material having a density of approximately 100 to 110 kg/m$^3$;

a second outer core, on a second side of the inner core, comprising a third material having a density of approximately 100 to 110 kg/m$^3$; and at least one external liner outside of the first outer core and the second outer core; and at least one strap directly or indirectly connected to the main body.

10. The chest protector of claim 9 wherein the second and third materials comprise the same material.

11. The chest protector of claim 9 wherein the inner core has a thickness greater than the combined thickness of the first and second outer cores.

12. The chest protector of claim 11 wherein the inner core has a thickness of approximately 14.5 mm to 15.5 mm, and the first and second outer cores each have a thickness of approximately 3.5 to 4.5 mm.

13. The chest protector of claim 12 wherein the inner core and the first and second outer cores form a symmetrical padding layup, such that impact-absorbing properties of the chest protector are substantially equal for impacts occurring against the first side and the second side of the chest protector.

14. The chest protector of claim 9 wherein the inner core is compression-molded to the first and second outer cores, which are compression-molded to the external liner.

15. The chest protector of claim 9 wherein the external liner comprises a spandex material.

* * * * *